US007396448B2

(12) United States Patent
Inoue et al.

(10) Patent No.: US 7,396,448 B2
(45) Date of Patent: Jul. 8, 2008

(54) METHOD FOR ROLL TO BE PROCESSED BEFORE FORMING CELL AND METHOD FOR GRINDING ROLL

(75) Inventors: Manabu Inoue, Kuki (JP); Kazuhiro Sukenari, Chiba-ken (JP); Noriko Matsumoto, Toride (JP); Tomoyuki Konuma, Kashiwa (JP); Tatsuo Shigeta, Nagareyama (JP)

(73) Assignee: Think Laboratory Co., Ltd., Chiba-Ken (JP)

( * ) Notice: Subject to any disclaimer, the term of this patent is extended or adjusted under 35 U.S.C. 154(b) by 528 days.

(21) Appl. No.: 10/951,782

(22) Filed: Sep. 29, 2004

(65) Prior Publication Data

US 2006/0065533 A1 Mar. 30, 2006

(51) Int. Cl.
*C25D 5/52* (2006.01)

(52) U.S. Cl. ..... 205/222; 205/151

(58) Field of Classification Search ..... 205/149, 205/151, 222; 204/222, 224 M, 228.1
See application file for complete search history.

(56) References Cited

U.S. PATENT DOCUMENTS

| | | | | | |
|---|---|---|---|---|---|
| 3,162,588 | A | * | 12/1964 | Bell | 205/662 |
| 3,923,610 | A | * | 12/1975 | Bergin et al. | 205/103 |
| 4,294,673 | A | * | 10/1981 | Kimoto et al. | 205/663 |
| 4,609,450 | A | * | 9/1986 | Seimiya et al. | 204/217 |
| 5,186,811 | A | * | 2/1993 | Otani et al. | 205/125 |
| 5,294,309 | A | * | 3/1994 | Seimiya et al. | 205/660 |
| 6,547,936 | B1 | * | 4/2003 | Metzger | 204/212 |

FOREIGN PATENT DOCUMENTS

| | | | |
|---|---|---|---|
| DE | 24 15 705 | A1 | 10/1975 |
| EP | 0 882 817 | A2 | 12/1998 |
| EP | 1 449 649 | A2 | 8/2004 |
| JP | 05-031628 | A1 | 2/1993 |

OTHER PUBLICATIONS

European Search Report for EP 04 02 3213 completed on Feb. 25, 2005.

* cited by examiner

*Primary Examiner*—Nam X Nguyen
*Assistant Examiner*—Luan V Van
(74) *Attorney, Agent, or Firm*—Rader, Fishman & Grauer PLLC

(57) ABSTRACT

There are provided a plating method for a roll and a grinding method before a cell is formed in which copper sulfate plating having a uniform thickness without any particles or pits can be applied to the roll for a gravure printing, both a middle finish grinding and a mirror surface finish grinding not depending on a grinding stone grinding can be carried out in a short period of time and a high quality roll can be provided. The grinding is carried out after applying the copper sulfate plating to the roll to attain a mirror surface finish state. The copper sulfate plating is carried out in such a way that non-soluble anode having a length more than the maximum roll length is ascended to the rotating process roll and approached to the lower surface of the roll, plating liquid having some avoidable impurities becoming a cause of particles or pits removed through a filter so as to perform a plating having no thickened portions at both ends of the roll.

8 Claims, 5 Drawing Sheets

METHOD FOR ROLL TO BE PROCESSED BEFORE FORMING CELL AND METHOD FOR GRINDING ROLL

BACKGROUND OF THE INVENTION

1. Field of Invention

This invention relates to a roll to be processed (hereinafter referred to "roll") before forming a cell and a grinding method for the roll in which a thickened copper sulfate plating with a uniform thickness having no nibs or pits can be applied to a roll for a gravure printing, a middle finish grinding and a mirror finish grinding not depending on a grinder stone grinding can be carried out within a short period of time and a high quality roll can be provided.

2. Description of Related Art

Two types of printing plate manufacturing method of a roll for a gravure printing will be described as follows.

(1) A laser printing plate manufacturing step for a direct printing plate type roll performs steps for performing a middle finish grinding, a final finish grinding and a mirror surface finish grinding with a grinder stone after performing an ultra precision cylinder machining through a roll loading and lathe, or performing a cell-image cutting and grinding to cut a specified thickness after performing a cylinder grinding to correct it into a true circle by peeling chromium with hydrochloric acid—degreasing—nickel plating—middle finish grinding, final finish grinding and a mirror surface finish grinding by plating with copper sulfate. Then, the subsequent steps are spraying and forming a photo—sensitive film—printing of image with a laser exposure device—development with alkali—forming of a cell with engraving—peeling of resist with strong alkali—chromium plating—grinding with a sand paper—unloading.

(2) A laser printed plate making step for a ballade plating type roll performs steps of loading of roll with used ballade copper plating being removed—degreasing—slight contacting surface treatment coated with photographic waste liquid—copper sulfate plating—middle finish grinding, final finish grinding and mirror surface finish grinding with a grinding stone. Then, subsequent steps are spraying and forming of a photo—sensitive film—printing of image with a laser exposure device—alkali development—forming of a cell with etching—peeling of resist with strong alkali—chromium plating—grinding with a sand paper—unloading.

In addition to the aforesaid steps, there is provided an engraving printed plate made by either an electronic engraving machine or a laser engraving machine and the like.

As the prior art documents related to the gravure printed plate making technology, there are Japanese Patent Application Nos. Hei 10-193551, 10-193552; Japanese Patent Laid-Open Nos. 2000-062342, 2000-062343, 2000-062344, 2001-179923, 2001-179924, 2001-187440, 2001-187441, 2001-191475, 2001-191476, 2001-260304, 2002-127369, 2002-187249, 2002-187250, 2002-200728, 2002-200729, 2002-307640 and 2002-307641 and the like.

In the prior art copper sulfate plating method and device for a process roll for a graver printing, it is well known that an anode including phosphorized copper is used as an anode for electrically plating copper, wherein as one of the anodes including phosphorized copper for this electrical plating, it is known to provide an anode including phosphorized copper having phosphor of 350 to 700 ppm, oxygen of 2 to 5 ppm; and the balance is composition including copper and unavoidable impurities.

The prior art copper sulfate plating method and device for a roll for a gravure printing were set such that a cassette type roll chuck rotary transferring unit was mounted on a main body frame of a plating device, the roll for a gravure printing chucked at its both ends by the cassette type roll chuck rotary transferring unit was connected to a cathode, immersed in plating liquid stored in a plating tank, rotated in it phosphorized copper, balls acting as plating metal immersed in the plating liquid were applied as an anode and a plating current was flowed between the anode and the roll. Then, the phosphorized copper balls including oxygen of 2 to 5 ppm and Phosphor of 350 to 700 ppm are fed into and supplemented to the anode cage of the plating tank to perform plating at a high current density of 10 to 15 A/dm$^2$.

The phosphorized copper balls contain unavoidable impurities and black anode sludge adhere to the surfaces of the plating metallic copper balls. Then, the anode sludge were removed away from the plating metallic copper balls through agitation of liquid and dissolution of the plating metallic copper balls, the sludge floated in the plating liquid, adhered to the roll to become either some nibs (minute protrusions) or pits (pin-holes).

In addition, it was necessary to perform a maintenance work for discharging the plating liquid regularly, diluting the liquid to attain plating liquid having a suitable copper ion concentration so as to eliminate some disadvantages that too much amount of dissolution of the plating metallic copper balls and too high copper ion concentration in the plating liquid prevent an appropriate copper sulfate plating from being carried out.

Further, also in the case of performing an electrical copper plating method for a semiconductor wafer, there employs a method in which the phosphorized copper balls are applied as anode and a plating current is flowed.

[Patent Document 1] Gazette of Japanese Patent Laid-Open No. Hei 5-214586

[Patent Document 2] Gazette of Japanese Patent Laid-Open No. Hei 8-67932

[Patent Document 3] Gazette of Japanese Patent Laid-Open No. Hei 11-061488

[Patent Document 4] Gazette of Japanese Patent Laid-Open No. 2003-171797

[Patent Document 5] Gazette of Japanese Patent Laid-Open No. 2002-275698

In the prior art copper sulfate plating method and device for a process roll for use in a gravure printing, a plating method and a device employing non-soluble anode are not employed at all.

As the copper sulfate plating method using a non-soluble anode other than the method for dissolving the phosphorized copper balls, there are present some technical documents as follows.

[Patent Document 6] Gazette of Japanese Patent Laid-Open No. 2003-166100

[Copper power used in a copper plating method and a method for using copper powder]

[Patent Document 7] Gazette of Japanese Patent Laid-Open No. 2002-068743

[Method for manufacturing easy-dissolving copper oxide; easy-dissolving copper oxide, copper plating material; and copper plating method]

[Patent Document 8] Gazette of Japanese Patent Disclosure No. 2002-515549

[Electrical copper plating method for substrate]

[Patent Document 9] Gazette of Japanese Patent Disclosure No. Hei 08-501827

[Copper electrolytic plating method and device]

As apparent from the aforesaid printed plate manufacturing steps, there are present several processing steps performed by a grinding-stone type grinder, wherein it takes time more than 30 minutes for a grinding before performing the copper sulfate plating and another grinding after performing the copper sulfate plating. In addition, as the grinding-stone type grinder device, it is necessary to prepare four types of grinding stones, i.e. a rough finishing grinder stone for a cell-cutting, a middle finish grinder stone, a final finish grinder stone and a mirror surface finish grinder stone required up to a mirror surface state. Further, it is necessary to have a general characteristic capable of accommodating for a roll size from 100 mmϕ×1,000 mm to 300 mmϕ×2000 mm. It is necessary to install an automatic changer mechanism for a grinder stone and two-head grinding or four-head grinding to perform a concurrent grinding from both sides to shorten the required time. Due to this fact, the grinding stone type grinder device is a quite expensive facility. Further, since the grinding stone type grinder device is a wet-type device, this device is not friendly with moisture and cannot be installed in the same room for a photosensitive film coating device or laser exposure device. In turn, this is not constructed such that the roll while being chucked at the cassette type roll chuck rotary transferring unit transferred by a stacker crane installed at the plating line can be ground.

In the case of the prior art method and device for grinding a roll for a gravure printing operation, the electrolytic grinding particle grinding method and device therefore are not employed at all.

As the electrolytic grinder particle grinding method and apparatus therefore, following technical documents are present.

[Patent Document 10] Gazette of Japanese Patent Laid-Open No. Hei 10-156627
[Electrolysis mirror surface finish grinding method for tungsten]

[Patent Document 11] Gazette of Japanese Patent Laid-Open No. Hei 10-086020
[Electrolysis machining method and device for dynamic pressure groove in dynamic pressure bearing]

[Patent Document 12] Gazette of Japanese Patent Laid-Open No. Hei 09-192933
[Minute amount electrolytic machining method and device]

[Patent Document 13] Gazette of Japanese Patent Laid-Open No. Hei 09-192932
[Electrolysis minute groove machining method and device]

[Patent Document 14] Gazette of Japanese Patent Laid-Open No. Hei 07-241728
[Electrolysis grinder particle grinding method for stainless steel]

[Patent Document 15] Gazette of Japanese Patent Laid-Open No. Hei 07-185938
[High-speed electrolytic rough finishing method and device therefore]

[Patent Document 16] Gazette of Japanese Patent Laid-Open No. 06-023663
[Ultra-smoothing non-contact grinding method and device therefor]

In accordance with the aforesaid prior art copper plating method in which the phosphorized copper balls are applied as anode, non-avoidable impurities are accumulated in the plating liquid, and the non-avoidable impurities adhere to the surface of the process roll to become a cause of forming small particles or pits. Employing the copper plating method with the phosphorized copper balls of high purity being applied as an anode may lead to an increased cost of plating work and so this cannot be employed.

In addition, in accordance with the copper plating method in which the prior art phosphorized copper balls are applied as an anode, a long distance between the anode and the roll caused a plating current to be concentrated at both ends of the roll and further a plating thickness was made high near both ends of the roll. Due to this fact, points near both ends were substantially ground when a grinding for a cylinder member was carried out with a grinder stone. The grinder stone type cylindrical member grinding device is large in size, expensive in its price, it takes much time for a machining work, so that studying of employing the electrolytic grinding device of small-size, less-expensive and requiring a short machining time showed that the electrolytic grinding device cannot perform a grinding operation so as to cause the non-uniform plating thickness to become uniform, resulting in that applying the electrolytic grinding device required a structure of a plating system capable of making a plating thickness uniform over an entire length of the phosphorized copper balls.

SUMMARY OF THE INVENTION

In order to overcome the aforesaid problems, the present inventors et. al considered a procedure for applying a copper plating process to the roll by using non-dissoluble anode. This method uses, as the non-dissoluble anode, material coated with catalyst at the surface of titanium, for example, makes plating liquid outside the plating tank, catches the non-dissoluble impurities through a filter, uses the plating liquid not including any non-dissoluble impurities and no anode sludge is generated. However, there is no example in which it is employed in the roll plating line for a gravure printing.

The present inventors et. al installed a plating device having a plating tank having dissoluble anode and a plating liquid supplementing tank making the plating liquid and circulating the liquid between itself and the plating tank; installed the cassette type roll chuck rotary transporting unit transferred by the stacker crane at the plating device main body frame; arranged a study facility having a configuration in which the roll chucked at its both ends by the cassette type roll chuck rotary transporting unit is positioned at the upper part of the aforesaid plating tank, and further studied earnestly how to enable a plating having a uniform thickness over its entire length of the rolls of various kinds of different sizes to be attained in what manner without producing any nibs or pits by installing dissoluble anode arranged at the plating tank.

As a result, the present inventors et. al discovered that the plating can be carried out without having any nibs or pits by catching and removing unavoidable impurities contained in the plating liquid during a process for feeding the plating liquid from the plating liquid supplementary tank to the plating tank; and then discovered that when the dissoluble anode electrically energized to cause the roll opposing surfaces to be smooth, parallel with the roll and become an anode is set near the lower surface of the roll with a gap of about 5 mm to 30 mm and a plating current is flowed there, a plating of uniform thickness can be carried out over an entire length of the roll without generating any influence of concentrated current by a turning-in of the plating current at both ends of the roll; and further found that a plating of predetermined thickness can be attained within a short period of time by flowing a high current through radiation of a supersonic wave or reducing a plating liquid immersion area of the roll or applying a shower and the like. Then, the present inventors got a result that can be related to an automatic operation and unmanned operation in the plating line by an automatic supplementing of a requisite amount of fine copper powder or sulfuric acid at the plating liquid supplementing tank while detecting both a relation between a copper concentration of the plating liquid and a calculated plating current and a concentration of sulfuric acid because plating of many rolls causes the copper concentration and sulfuric acid concentration of the plating liquid to be lack.

Subsequently, the present inventors et. al studied to abandon the grinding stone type grinder from the printed plate line and started to study and develop a facility of an electrolytic grinding particles grinder device in place of the grinding stone type grinder.

The present inventors et. al at first mounted a cassette type roll chuck rotary transferring unit substantially the same as the cassette type roll automatic loading or unloading device shown in the gazette of Japanese Patent Publication No. Sho 57-36995 on the water cleaning device; stored electrolytic plating liquid composed of pure water-sodium nitrate 1 wt %-grinding particles 1 wt % with a particle diameter of 0.8 μmϕ or less in the cleaning water storing tank; provided at the rear part of the device an industrial robot acting as a grinder head reciprocating and moving means; prepared a grinder head main body having a concave cylindrical surface having the same size as the grinding particles at the extremity end of the robot arm; connected it to the cathode, overlapped porous resilient member having liquid immersion characteristic with the concave cylindrical surface being applied as an electrode; and finally prepared a grinding head by overlapping a super fiber (more practically ZYLON™ (a registered trademark=a product of Toyobo Co., Ltd.) having a high creep characteristic, high strength and high anti-temperature durability on the surface, made a grinding system and tried to perform an electrolytic grinder particle grinding operation.

Further, ZYLON™ is a fiber made of polyparaphenylenebenzobisoxiasol (PBO) having a rigid and quite high linear characteristic molecular structure spun in liquid crystal state, its size is mere 1 mmϕ, and has a remarkable strength for hanging down 450 kg, the highest level strength, high coefficient of elasticity, anti-heat characteristic and anti-fire characteristic in the existing organic fibers, so that the present inventors et. al employed this fiber.

The process roll was chucked at both ends to the cassette type roll chuck rotary transferring unit to connect the process roll to the anode, the roll was rotated at a predetermined number of rotation, the process roll was depressed by the grinder head, electrolytic liquid was applied in its shower form, an electrolytic current was flowed there to perform the grinding operation. This grinding theory is applied for scraping off the non-active film covering the protruded portions of micro-size in the non-active film formed at the opposing surface of the grinder head of the process roll with the grinding particles caught at the surface of super fiber at the grinding head by flowing an electrolytic current, the micro-size protruded portions from which the non-active film is removed are dissolved and made flat. However, the roll could not be ground effectively. Accumulation of the non-active film acting to cause the surface of the process roll not to be electrically decomposed from a time elapsed from a starting time by a relative short time prohibited an effective grinding of the roll. It has bas been cleared that flowing of the electrolytic current causes the non-active film formed at a portion of the roll surface corresponding to the grinding head not to be removed, the film becomes an oxidized film as time elapses, the oxidized film becomes a film that is hardly removed by the grinding particles and accumulated.

In addition, it has been found that grinding of the process roll with the grinding particles while catching the grinding particles in the electrolytic liquid at the surface of the super fiber of the grinding head is not promoted well.

Further, when the grinding pressure is low, it has been found that grinding with the electrolytic grinding particle is slightly carried out, and it has been found that increasing of the grinding pressure causes the grinding with the electrolytic grinding particle to be increased. However, it has been found that even if a grinding pressure is increased up to such a limit as one not producing any trouble against rotation of the chuck at the process roll, the non-active film is accumulated and the grinding particles contained in the electrolytic liquid cannot remove the non-active film in an effective manner.

In view of the foregoing, grinding with electrolytic grinding particles was carried out by the grinding head in which in place of the super fiber, a sponge-like resilient member having grinding particles corresponding to the grinding stone of No. 800 fixed to it (more practically, SCOTCH-BRIGHT™ [a registered trademark=a product of Sumitomo 3M Co., Ltd.] of a structure having some grinding particles adhered to a nylon non-woven fabric).

As a result, it has been found that as time elapses, the non-active film is not removed, but the film is accumulated in a dotted pattern as an oxidized film and the grinding with electrolytic grinding stones is prohibited.

Then, a time in which an electrolytic current is flowed and another time in which an electrolytic current is not flowed were alternatively changed by 20 seconds, resulting in that an oxidation of the non-active film could be avoided, an entire grinding could be carried out by about 45 minutes and a checking of the surface roughness showed that it did not reach a precision of mirror surface finish grinding. The location where the grinding was completed showed purple color. This state was considered that the location was affected by alkali burn.

In view of the foregoing, it has been found that changing the electrolytic liquid into acid-based liquid does not cause the color to be changed into purple color. However, it has been found that when an electrolytic current is always flowed, the non-active film is oxidized and accumulated.

Thus, the grinding head was improved as follows in such a way that one grinding with electrolytic grinding particles while an electrolytic current is always flowed to perform it and the other grinding with grinding particles while an electrolytic current is not flowed to perform it are present concurrently.

The concave cylindrical surface of the grinding head main body was provided with an electrode connected to the cathode, two band-like plate rubbers were overlapped, the middle electrode at the concave cylindrical surface was exposed, the porous resilient member (sponge) was overlapped on a groove where the electrode was exposed to make them flat and finally SCOTCH-BRITE™ was overlapped as a grinding web to provide a grinding head. The result of grinding operation showed that a rough finish grinding not leaving any particles could be accomplished in about 15 minutes.

This grinding head shows that a flowing of electrolytic current is assured through a presence of the electrolytic liquid because the porous resilient member is overlapped on the groove where the electrode exposes, the grinding particles fixed to SCOTCH-BRITE™ scrapes off the non-active film covering the micro-size protrusions in the non-active film instantly formed at the surface location opposing against the groove where the electrode of the process roll is exposed by flowing the electrolytic current, the electrolytic current dissolves the micro-size protrusions having the non-active films removed, a smoothening electrolytic grinding with grinding particles can be carried out and at the same time the plate rubbers overlap it to cause the upstream side and the downstream side of the porous resilient member have no electrolytic current, so that the non-active film is not formed and the surface location opposing against the groove where the electrode is exposed is ground with electrolytic grinding particles and subsequently SCOTCH-BRITE™ can perform the grinding operation with grinding particles (a rough finish grinding).

Subsequently, ZYLON™ of super fiber was overlapped on it in place of SCOTCH-BRITE™ having some grinding particles fixed there, the grinding with electrolytic grinding particles was carried out against the process roll just finished in plating of copper sulfate, resulting in that the mirror surface finish grinding could not be carried out. Then, the grinding with electrolytic grinding particles was carried out against the process roll just finished the rough finish grinding with the aforesaid SCOTCH-BRITE™, resulting in that the mirror surface finish grinding could be performed in about 15 minutes.

In addition, after the cell was formed by the grinding head with SCOTCH-BRITE™ having some grinding particles fixed there being overlapped, the grinding of electrolytic grinding particles was carried out against the process roll having hard plating there, chromium plating burrs extending at the corner of the cell could be removed within a short period of time.

Then, in order to perform either a rough finish grinding or a mirror surface finish grinding against the process rolls for a gravure printing having various sizes of a diameter of 80 mm to 300 mm while preparing one grinding head of a block member with the concave cylindrical surface of a radius of curvature of 150 mm, for example, a superior grinding cannot be carried out because a contact angle between SCOTCH-BRITET™ or ZYLON™ and the process roll becomes small.

Thus, the present inventors made the grinding head capable of pressing against SCOTCH-BRITE™ or ZYLON™ against the process roll in a superior manner in such a way that a contact angle between SCOTCH-BRITE™ or ZYLON™ and the process roll is made variable and repeated an experiment of grinding with the result that a superior mirror surface finish with the grinding of electrolytic grinding particles could be realized. In addition, even if the rotary driving type grinding disk capable of being reciprocated was made, the electrodes were embedded in a radial direction and circular SCOTCH-BRITE™ or ZYLON™ was overlapped to perform a grinding operation, a superior mirror surface finish through the grinding with the electrolytic grinding particles could be realized.

The present invention could be accomplished through the aforesaid procedures.

The present invention has a dissolving problem to provide a method for plating a process roll before forming a cell and a grinding method in which a thick copper sulfate plating having a uniform thickness without any particles or pits can be applied to a process roll for a gravure printing, a middle finish grinding and a mirror surface finish grinding can be performed within a short period of time without being dependent on the grinding with grinder stone to provide a high quality process roll, in particular, a plating system using non-soluble anode can be applied to the process roll for a gravure printing and a plating system capable of applying not the grinding with grinder stone but electrolytic grinding can be realized.

The invention described in Claim 1 is a plating method for a roll and a grinding method before a cell is formed in which copper sulfate plating is applied to the process roll and then the grinding is carried out for the roll to attain a mirror surface finish state, said copper sulfate plating is constituted to perform plating in such a way that the roll acting as a member to be plated is rotatably supported at its both ends and positioned in a plating tank and electrically energized to become a cathode and rotated at a predetermined number of rotation, a non-soluble anode arranged to be positioned below said roll and having a length more than the maximum length of the roll and having roll opposing smooth surfaces in parallel with the roll and electrically energized to become an anode is ascended and approached the lower surface of the roll, and plating liquid having non-avoidable impurities becoming a cause of particles or pits removed through a filter is supplied; and said grinding is carried out such that the roll is rotatably supported at its both ends, connected to the anode, and rotated, liquid immersion type grinding particle fixed flexible member having grinding particles fixed to a non-woven fabric of high frictional strength or super fiber is overlapped on the grinding head main body provided with an electrode connected to a cathode at a part of the roll pressing surface, either said liquid immersion type grinding particles fixed flexible member or the super fiber is closely contacted with said roll and electrolytic liquid is supplied to the close contacting surface, it is pressed against the roll by said concave cylindrical surface, the grinding head is reciprocated in a longitudinal direction of the roll surface, an electrolytic grinding is carried out at one portion of the roll corresponding to the electrode and a frictional grinding is carried out at the other portion where no electrolytic current flows.

The invention described in Claim 2 is a plating method for a roll and a grinding method before a cell is formed in which copper sulfate plating is applied to the roll, a middle finish grinding is carried out, and then a mirror surface finish grinding is carried out, said copper sulfate plating is constituted to perform plating in such a way that the roll acting as a member to be plated is rotatably supported at its both ends and positioned in a plating tank and electrically energized to become a cathode and rotated at a predetermined number of rotation, a non-soluble anode arranged to be positioned below said roll, having a length more than the maximum length of the roll and having roll opposing smooth surfaces, in parallel with the roll and electrically energized to become an anode is ascended and approached the lower surface of the roll, and plating liquid having non-avoidable impurities becoming a cause of particles or pits removed through a filter is supplied; and said middle finish grinding is carried out such that the roll is rotatably supported at its both ends, connected to the anode, and rotated, liquid immersion type grinding particle fixed flexible member having grinding particles fixed to a non-woven fabric of high frictional strength is overlapped on the grinding head main body having a concave cylindrical surface and having an electrode connected to the cathode at a part of said concave cylindrical surface, said liquid immersion type grinding particles fixed flexible member is closely contacted with said roll and pressed against the roll by said concave cylindrical surface, electrolytic liquid is supplied to the close contacting surface between the roll and a grinding band, the grinding head is reciprocated in a longitudinal direction of the roll surface, the grinding band is reciprocated in a longitudinal direction of the roll surface, an electrolytic grinding is carried out at one portion corresponding to the electrode of the roll and a frictional grinding is carried out at the other portion where no electrolytic current flows, thereby the electrolytic grinding particle grinding using the grinding band and the grinding particle grinding are mixingly present to perform the middle finish grinding operation, said mirror surface finish grinding is carried out such that the roll is rotatably supported at its both ends, connected to the anode, and rotated, a flexible super fiber having a desired wide width and applied to the grinding head main body having a concave cylindrical surface and having an electrode connected to the cathode at a part of said concave cylindrical surface is closely contacted with said roll and pressed against the roll by said concave cylindrical surface, electrolytic liquid is supplied to the close contacting surface between the roll and the super fiber, the grinding head is reciprocated in a longitudinal direction of the roll surface, the super fiber is reciprocated in a longitudinal direction of the roll surface, an electrolytic grinding is carried out at one portion corresponding to the electrode of the roll and a frictional grinding is carried out at the other portion where no electrolytic current flows, thereby the electrolytic grinding using the super fiber and the frictional grinding are mixingly present to perform the mirror surface finish grinding operation.

The invention described in Claim 3 is a plating method for a roll and a grinding method before forming a cell as defined in Claim 1 or Claim 2 wherein said copper sulfate plating is carried out such that plating liquid added with copper inclusion fine powder of any one of cupric oxide powder, copper carbonate powder or copper sulfate powder to sulfuric acid, enabling copper sulfate plating to be carried out, is stored in a plating liquid supplementing tank, non-soluble impurities in the plating liquid are removed through a filter and the liquid is supplied to the plating tank provided with non-soluble anode to perform a plating.

The invention described in Claim 4 is a plating method for a roll and a grinding method before forming a cell as defined in Claim 3 wherein a copper concentration of plating liquid during its use is measured, a calculated plating current value is measured when the copper concentration lacks or every time one roll is processed in plating, a required amount of copper inclusive fine powder is supplemented automatically every time the plating processing is finished, a sulfuric acid concentration of the plating liquid during its use is measured and a required amount of sulfuric acid is supplemented automatically when the sulfuric acid concentration lacks.

Effects of the Invention Described in Claim 1

(1) Since the plating using the non-soluble anode and the electrolytic grinding particle grinding are combined, a uniform precise machining of a roll diameter before its plating over its entire length causes the roll diameter after plating to be kept at its uniform precision degree over its entire length, so that as the cylindrical grinding for the roll after plating, a grinding stone grinding is not applied, but the electrolytic grinding particle grinding making a slide contact of soft material can be applied, this is preferable for the copper sulfate plating process and the grinding process for the printed plate manufacturing line before the cell is formed, a superior copper sulfate plating not producing any pits or nibs as compared with the combination of the prior art plating method and the grinding stone grinding method can be realized, the roll diameter becomes uniform and a more superior mirror surface state than the mirror surface attained by grinding it with a sponge grinding stone of No. 6000 to No. 7000 can be obtained.

When the plating with non-soluble anode and the electrolytic grinding particle grinding are not combined, more practically when the prior art plating and the electrolytic grinding particle grinding are combined, a plating thickness near both ends of the roll surface becomes larger than that of the other portion and the electrolytic grinding particle grinding can not correct it to have a uniform roll diameter and even if the mirror surface grinding is carried out, either nibs or pits may be generated.

This point will be described more in detail as follows. This is a plating method using the non-soluble anode and it is possible to select any one of these methods in which as a copper source for supplementing in plating liquid phosphorized copper balls are melted at the plating liquid supplementing tank or cupric oxide powder, copper carbonate powder or copper sulfate powder is fed into the plating liquid supplementing tank. However, it is possible to supply the plating liquid having non-avoidable impurities becoming a cause of nibs or pits contained in the copper source caught and removed through a filter to the plating tank and to perform a plating, so that a superior copper sulfate plating not producing any pits or nibs can be carried out.

Then, the plating current in the prior art was concentrated at both ends of the roll because a distance between the anode and the roll is long and the plating thickness near both ends of the roll was increased. Due to this fact, the cylindrical grinding provided a substantial grinding near both ends of the roll. To the contrary, this invention is operated such that the opposing surfaces of the roll are smooth, the non-soluble anode in parallel with the roll is set near the lower surface of the roll to perform the plating, so that the plating current shows a uniform density over the entire length of the roll and a plating of uniform thickness can be carried out. That is, this has a general applicability for rolls having different diameter lengths because the non-soluble anode having a length more than the maximum length of the roll is ascended, set near the lower surface of the roll to perform the plating. Since the non-soluble anode is set near the roll to perform the plating, even if the length of the process roll is ½, for example, in respect to the non-soluble anode, the plating current is not concentrated near the end surface of the roll, a uniform plating current density is kept over an entire length of the roll so as to enable a plating of uniform thickness to be carried out. Accordingly, if the roll diameter before plating is machined uniformly in precision over the entire length, the roll diameter after plating operation is kept at a uniform precision density over the entire length, so that the cylindrical grinding of the roll after plating is not the grinding stone grinding but the electrolytic grinding particle grinding sliding contact with a soft material can be applied.

(2) Since this is a combination of the plating using the non-soluble anode and the electrolytic grinding particle grinding, the processing time can be substantially shortened. That is, this is a plating method in which the non-soluble anode is set near the roll, a plating thickness at both ends of the roll is not increased as compared with that at a middle part of the roll to enable the plating current density to be increased, so that the plating time can be shortened, the grinding time can also be substantially shortened and the line processing capability can be improved.

As to the fact that the grinding time can also be substantially decreased, this will be described as follows.

Flowing of the electrolytic current instantly forms the non-active film at the surface of the roll and at the opposing positions of the electrode plates. The non-active film is instantly formed because the electrolytic current flows at the part where the electrode is exposed. The non-active film covering the micro-size protrusion is scraped with the grinding web, the micro-sized protrusion having the non-active film removed is dissolved with the electrolytic current. In addition, a full surface grinding with the grinding web is also carried out a location where the electrolytic current does not flow because the accumulation of the non-active film is avoided. The cylindrical grinding can be carried out within a short period of time while not depending on the grinding stone grinder device against the used ballade-type process roll and the entire printed plate manufacturing time can be reduced, because the middle finish grinding and/or the mirror finish grinding can be carried out within a short time according to the kind of the grinding web.

Effects of the Invention Described in Claim 2

The same effects as the effects (1), (2) of the invention described in Claim 1 can be attained.

As to the grinding operation, further following effects can be attained.

The middle finish grinding after a cell-image cutting cylindrical precision machining performed by a lathe for the used direct plate type roll can be performed in a shorter time than that of the prior art grinding stone grinding device due to a combined grinding operation of the electrolytic grinding particle grinding using SCOTCH-BRITE™ or the like and the grinding particle grinding.

Then, as to the mirror surface finish grinding after plating, the middle finish grinding having the electrolytic grinding particle grinding using SCOTCH-BRITE™ or the like and the grinding particle grinding combined, and the mirror surface finish grinding having electrolytic grinding using ZYLON™ or the like and the frictional grinding combined can be carried out in a quite shorter time than that of the processing steps of the middle finish grinding—fine finish grinding—mirror surface finish grinding performed by the prior art grinding stone grinder.

In addition, the middle finish grinding after a cell-image cutting cylindrical precision machining performed by a lathe for the used ballade-type roll can be performed in a shorter time than that of the prior art grinding stone grinding device due to a combined grinding operation of the electrolytic grinding particle grinding using SCOTCH-BRITE™ or the like and the grinding particle grinding.

Then, as to the mirror surface finish grinding after plating, the middle finish grinding having the electrolytic grinding particle grinding using SCOTCH-BRITE™ or the like and the grinding particle grinding combined, and the mirror surface finish grinding having electrolytic grinding using ZYLON™ or the like and the frictional grinding combined can be carried out in a quite shorter time than that of the processing steps of the middle finish grinding—fine finish grinding—mirror surface finish grinding performed by the prior art grinding stone grinder.

Additional Effects of the Invention Described in Claim 3

Use of the copper balls is stopped and plating liquid enabling a copper sulfate plating added with cupric oxide powder, copper carbonate powder or copper sulfate powder to sulfuric acid to be carried out is used, so that even if a high current is flowed to perform a powerful plating, occurrence of lack of copper source material can be avoided.

Additional Effects of the Invention Described in Claim 4

Although when phosphorized copper balls and sulfuric acid were supplemented in the prior art, a required amount of them was supplemented after an operation of the line was stopped and measurement was performed, the present invention can realize an automatic measurement and an automatic supplementation for the copper source material as well as management over copper ion concentration and sulfuric acid concentration of the plating liquid, so that it is possible to avoid stopping of an operation of the plating line when the copper source is to be supplemented and an operation rate of the line can be increased, and in addition, it is possible to avoid a manual handling of toxic cupric oxide powder, copper carbonate powder or copper sulfate powder.

BRIEF DESCRIPTION OF THE DRAWINGS

FIG. 5 shows a side elevational view in longitudinal section of a grinding head of a cylindrical grinding device of a preferred embodiment 3 of the present invention, wherein

DETAILED DESCRIPTION OF PREFERRED EMBODIMENTS

Figure 1:
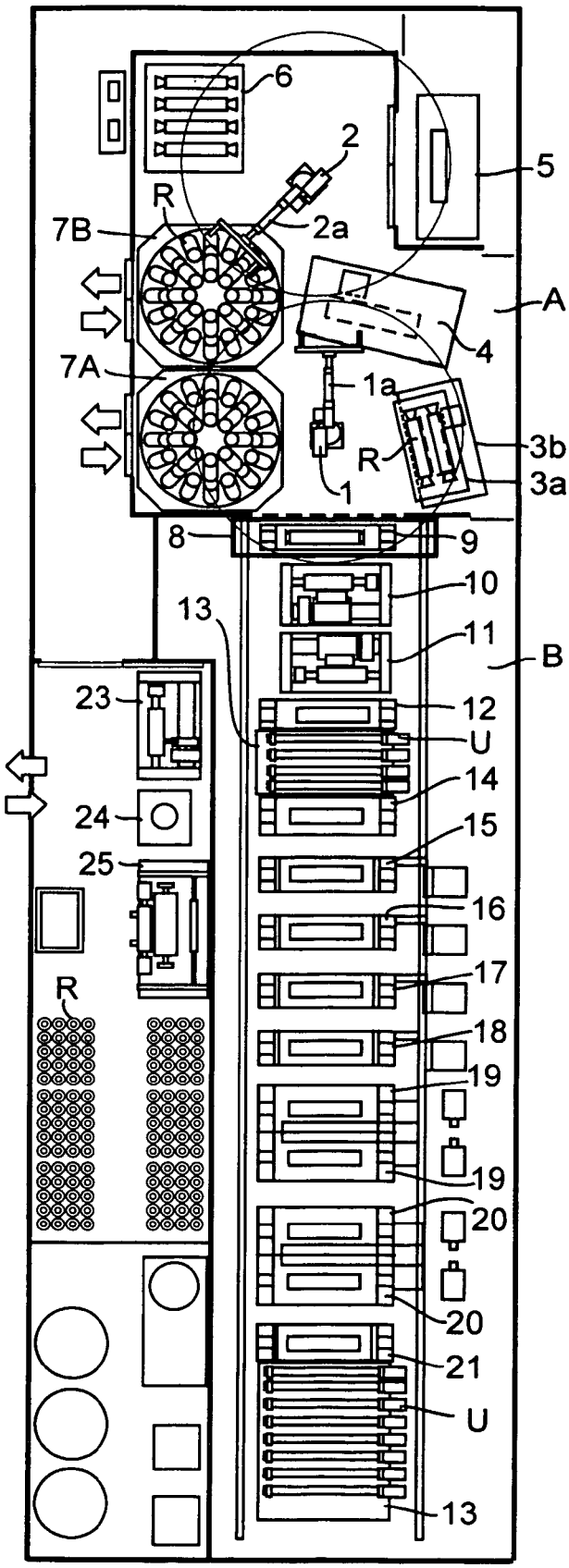
FIG. 1 shows a top plan view of a printed plate manufacturing factory of a preferred embodiment 1 of the present invention.

As indicated in the preferred embodiment 1, a factory facility is divided into a robot room and a plating room; the robot room is installed with an industrial robot and a turntable type roll stock device; and in order to enable any one of various types of printed plate manufacturing methods to be carried out, a photosensitive film drying promotion device, a photosensitive film coating device and a laser exposure device are installed in response to a laser photosensitive operation, a development and an etching printed plate making; a photosensitive film drying promotion device, a black film coating device for laser ablation, and a laser exposure device for ablation are installed in response to a laser ablation and an etching printed plate making; a laser curving device is installed in response to a laser curving printed plate making and an electronic curving device is installed in response to an electronic curving printed plate making. The plating room is installed with a plating line facility having as its main facilities, a copper sulfate plating device for plating the roll or a chromium plating device or a nickel plating device below the running line of a stacker crane installed at the ceiling of the plating room.

In particular, as indicated in the preferred embodiment 2, as the copper sulfate plating device, there is provided a copper sulfate plating device using non-soluble anode and automatically supplementing the fine powder including copper and sulfuric acid and at the same time as a grinding means, there is employed a grinding method accompanied by an electrolytic grinding. As indicated in the preferred embodiment 3, it is preferable to install the middle finish grinding device and the mirror finish grinding device.

The plating tank is preferably constituted as a fixed tank, plating liquid is supplied from the plating liquid supplementing tank after the roll chucked with the roll rotating means is positioned within the plating tank, the plating liquid surface is raised, the plating liquid causes the roll to be immersed entirely or only by about ⅓ of a diameter, the plating liquid overflowing at a predetermined liquid surface level is returned back to the plating liquid supplementing tank, or constituted as a free ascending or descending movable tank and further constituted such that the movable tank ascends by a desired stroke in response to a diameter of the roll after the roll chucked by the roll rotating means is positioned in the plating device main body, the roll is positioned in the tank, the plating liquid is supplied from the plating liquid supplementing tank, the liquid surface ascends, the plating liquid causes the roll to be immersed in the liquid by about ⅓ of the diameter to about ¼ of the diameter and the plating liquid overflowing to keep the liquid surface level is returned back to the plating liquid supplementing tank.

This copper sulfate plating method and device for a roll are operated such that plating liquid is made at the plating liquid supplementing tank and copper ion is supplied to the plating tank. The plating liquid generating method includes some operations for feeding phosphorized copper balls in the plating liquid supplementing tank; agitating air; dissolving them under mutual action of free sulfuric acid and dissolved oxygen in the plating liquid to generate copper ion (positive ion); and supplying copper ion lacked in the plating tank by a liquid supplying means comprised of a check valve type liquid lifting port, liquid lifting pump, pipes, flow rate adjusting valve and filter for catching unavoidable impurities or the like. In this case, this device is preferably constituted such that dissolving of copper is promoted by making metallic copper immersed in the plating liquid contact more precious metals than copper such as gold, platinum and palladium or the like and by agitating air.

However, as described above, it is more preferable not to employ a system for dissolving phosphorized copper balls, but employ a system for supplementing in the plating liquid supplementing tank fine powder including copper such as cupric oxide powder, copper carbonate powder or copper sulfate powder having an easy dissolving characteristic against sulfuric acid and easily generating copper ion.

When the system is installed at the line, it is desirable that the system is provided with separately one cylindrical grinding device for scrubbing with grinding particle fixing liquid immersion flexible member with grinding particles being fixed to a non-woven fabric having a high frictional strength such as SCOTCH-BRITE™ (a registered trademark) or the like to enable a rough finish cylindrical grinding to be carried out and the other cylindrical grinding device capable of scrubbing with a grinding web of super fiber and not fixed with grinding particles to enable a mirror surface finish grinding to be carried out.

The cylindrical grinding device capable of performing a rough finish cylindrical grinding with the grinding particle fixing liquid immersion flexible member can remove and grind chromium plating burrs. Although it is possible to apply a double-head type two-stage grinding cylindrical grinder device provided with one grinding head for performing a rough finish cylindrical grinding and the other grinding head for performing a mirror surface finish grinding, their separate arrangement is preferable because their separate arrangement has a high processing capability.

It may also be applicable that a grinding operation is carried out by a system having a grinding head longer than a process roll of maximum length (about 1300 mm) by 100 mm, for example, its full length concurrently abuts against the grinding head even under a reciprocating stroke of the grinding head for grinding operation set to about 100 mm; or a grinding operation is carried out by a system having a grinding head with a substantial same length as that of the roll of minimum length (about 500 mm), a reciprocating stroke for a grinding of the grinding head is about 100 mm against the roll of a minimum length (about 500 mm), or a reciprocating stroke of the grinding head at the time of grinding operation against the roll of a maximum length (about 1300 mm) is about 900 mm.

The roll is constituted such that it is chucked at its both ends, connected to the anode and rotated. One grinding head for performing a rough finish cylindrical grinding and the other grinding head for performing a mirror surface finish grinding are preferably a variable type grinding head having a back-up function capable of taking a large contact angle between SCOTCH-BRITE™ or ZYLON™ and the process roll against the process roll for a gravure printing having various sizes of a diameter ranging from 80 mm to 300 mm, for example.

More practically, the device of the present invention is constituted such that the roll is chucked at its both ends, connected to the anode and rotated; it has a grinding head main body for making a flexible grinding band of desired wide span contact closely said roll and press said grinding band against the roll; a part of said concave cylindrical surface has an electrode connected to a cathode; electrolytic liquid is supplied to the close contact surface between the roll and the grinding band, the grinding head is reciprocated in a longitudinal direction of the roll, the grinding band is reciprocated in a longitudinal direction of the roll surface, an electrolytic grinding is carried out at a portion of the roll corresponding to the electrode and a frictional grinding is carried out at the other portion where no electrolytic current flows.

Then, the grinding band is a grinding particle fixing liquid immersion flexible member such as SCOTCH-BRITE™ (a registered trademark) or the like having some grinding particles fixed at a non-woven fabric having a high frictional strength, this is constituted such that an electrolytic grinding particle grinding is carried out at one portion of the roll corresponding to the electrode and a frictional grinding particle grinding is carried out at the other portion where no electrolytic current flows. Or the grinding band is a super fiber such as ZYLON™ (a registered trademark) or the like having a high frictional strength, anti-heat strength and creep strength, an electrolytic frictional grinding is carried out at one portion of the roll corresponding to the electrode and a frictional grinding is carried out at the other portion where no electrolytic current flows.

Further, the grinding head main body is constituted such that the two horizontal bars are supported at their both ends under their spaced-apart relation by the right and left leg opening links which can be freely opened or closed and normally biased to be opened, the grinding band pressing web provided with band-like electrodes at the two horizontal bars is fixed at its both ends and tensioned in a plane-like manner, said grinding head main body can be moved by a desired size relatively to approach the roll and this motion causes the grinding band pressing web to wind the grinding band around the roll and to press against it.

In the case of the variable grinding head, SCOTCH-BRITE™ or ZYLON™ can attain a uniform sliding contact over an entire length of contact length in a roll circumferential direction against the roll.

When the grinding particle fixing liquid immersion flexible member such as SCOTCH-BRITE™ or the like having grinding particles fixed at the non-woven fabric is used, an electrolytic grinding particle grinding is carried out at one portion of the roll corresponding to the electrode and a frictional grinding is carried out along with the former grinding at the other portion where no electrolytic current flows, thereby a rough finish grinding is carried out. This system can be applied to a grinding before copper sulfate plating, grinding after copper sulfate plating and a grinding for removing chromium plating burrs.

When the grinding web of super fiber such as ZYLON™ or the like and having no grinding particles fixed there is used, an electrolytic frictional grinding is carried out at one portion of the roll corresponding to the electrode and a frictional grinding is carried out at the other portion where no electrolytic current flows, thereby a mirror surface finish grinding is carried out. This system can be applied to a rough finish grinding after copper sulfate plating and a grinding after middle finish grinding.

The grinding band is closely contacted with the roll and pressed against the roll by the grinding head. However, this system includes one constitution having the grinding band and the grinding head separated from each other and the other constitution in which the grinding band and the grinding head are integrally assembled to each other. It is preferable to constitute that the grinding band moves in a reduced speed in its longitudinal direction during grinding operation and a grinding position of the grinding band in respect to the roll can be revised.

When the electrolytic liquid is alkaline liquid, the electrolytic grinding particle grinding for the copper sulfate plating shows an accumulation of non-active film. In order to perform a superior grinding of the entire cylindrical surface, the electrolytic liquid is acid liquid. Then, it is preferable that the electrolytic liquid is supplied to the close contact surface between the roll and the grinding band during grinding operation and alkaline liquid is rapidly applied in its shower form to the roll after grinding where the grinding band is moved away from the roll and the neutral water is applied in its shower form, and both alkaline shower water and neutral shower water are not mixed with acid electrolytic acid through opening or closing of a receiving pan or the like.

Since there are present various kinds of printed plate making method, the most preferable form of the present invention is classified as follows.

[Laser Photo-Sensing, Development and Etching Printed Plate Against a Direct Printing Type Roll]

The roll for using again a used direct printing type printing roll is processed by a series of processing steps as follows;

(1) a cell-image cutting cylindrical precision machining with a lathe (=a precision cylindrical machining in which the roll is chucked at a lathe at its both ends, rotated and cut by a cutting tool by about 25 μm to 50 μm);

(2) a middle finish grinding having an electrolytic grinding particle grinding and a grinding particle grinding performed together under application of liquid immersion grinding particle fixed flexible member having grinding particles fixed at a non-woven fabric with a high frictional strength as represented by SCOTCH-BRITE™;

(3) a copper sulfate plating using non-soluble anode (=the roll is chucked at its both ends, rotated at a desired speed, a lower half part of the roll is immersed in copper sulfate plating liquid and rotated to attain a copper sulfate plating having a desired thickness in 10 to 15 minutes, for example. Management of copper ion concentration and a sulfuric acid concentration of the plating liquid, an automatic measuring and an automatic supplementing operation for the copper source material such as cupric oxide powder and the like are carried out);

(4) middle finish grinding performed under a co-existence of electrolytic grinding particle grinding and grinding particle grinding using the liquid immersion grinding particle fixed flexible member;

(5) mirror surface finish grinding performed under a co-existence of electrolytic grinding and frictional grinding using a super fiber represented by ZYLON™ having a high frictional strength, anti-heat strength and creep strength;

(6) photo-sensitive film coating and forming (=the roll is chucked at its both ends, rotated at a desired speed, the photosensitive film coating head is approached one end of the roll, the head scans toward the other end of the roll, either positive type photo-sensitive agent or negative type photo-sensitive agent overflown from the photo-sensitive film coating head is coated uniformly to the roll through a fountain system, dried and solidified to form a film);

(7) image printing by a laser exposure device (=the roll is chucked at its both ends, rotated at a desired speed, the laser head is approached near one end of the roll, the head scans toward the other end of the roll, laser light is illuminated in response to the image data, the photo-sensitive film is exposed to light to form a latent image);

(8) development with alkaline liquid (=the lower half part of the roll is immersed in alkaline development liquid with pH of about 9.5 to 12.0, rotated in it to attain a resist image in about 45 to 60 seconds);

(9) cell formation with etching operation (=the lower half part of the roll is immersed in acid aqueous solution of cupric chloride or ferric chloride, rotated and its exposed metallic surface is chemically etched for about 7 to 8 minutes to engrave the cell);

(10) resist peeling (=the lower half part of the roll is immersed in strong alkaline development liquid with pH of about 12.0 to 13.0, rotated and the resist image is dissolved in about one minute and removed.); and

(11) forming of a hard film having a plate wear such as a hard chromium plating, nickel alloy plating that can be quenched, or titanium carbide film or DLC film or organic hard film and the like.

[Laser Ablation and Etching Printed Plate Against a Direct Printing Type Roll]

The roll for using again the used direct printing type printing roll is processed by a series of processing steps as follows;

(1) a cell-image cutting cylindrical precision machining with a lathe;

(2) a middle finish grinding by a.grinding having an electrolytic grinding particle grinding and a grinding particle grinding performed together under application of liquid immersion grinding particle fixed flexible member;

(3) a copper sulfate plating using non-soluble anode;

(4) middle finish grinding performed under a co-existence of electrolytic grinding particle grinding and grinding particle grinding using the liquid immersion grinding particle fixed flexible member;

(5) mirror surface finish grinding performed under a co-existence of electrolytic grinding and frictional grinding using a super fiber;

(6) black film coating and forming for a laser ablation;

(7) laser ablation performed by a laser ablation device;

(8) cell formation with etching operation;

(9) removal of a black film image;

(10) forming of a hard film having an anti-printing force such as a chromium plating or titanium carbide film or DLC film or organic hard film and the like.

[Electronic Curving Printed Plate Forming Against the Direct Printing Type Roll]

The roll for using again the used direct printing type printing roll is processed by a series of processing steps as follows;

(1) a cell-image cutting cylindrical precision machining with a lathe;

(2) a middle finish grinding by a grinding having an electrolytic grinding particle grinding and a grinding particle grinding performed together under application of liquid immersion grinding particle fixed flexible member;

(3) a copper sulfate plating using non-soluble anode;

(4) middle finish grinding performed under a co-existence of electrolytic grinding particle grinding and grinding particle grinding using the liquid immersion grinding particle fixed flexible member;

(5) mirror surface finish grinding performed under a co-existence of electrolytic grinding and frictional grinding using a super fiber;

(6) forming of a cell by an electronic curving device such as a HelioKlischograph or the like for driving a diamond curving needle to curve a cell; and (7) forming of a hard film having an anti-printing force such as a chromium plating or titanium carbide film or DLC film or organic hard film and the like.

[Laser Curving Printed Plate Forming Against the Direct Printing Type Roll]

The roll for using again the used direct printing type printing roll is processed by a series of processing steps as follows;

(1) a cell-image cutting cylindrical precision machining with a lathe;

(2) a middle finish grinding by a grinding having an electrolytic grinding particle grinding and a grinding particle grinding performed together under application of liquid immersion grinding particle fixed flexible member;

(3) a copper sulfate plating using non-soluble anode;

(4) middle finish grinding performed under a co-existence of electrolytic grinding particle grinding and grinding particle grinding using the liquid immersion grinding particle fixed flexible member;

(5) mirror surface finish grinding performed under a co-existence of electrolytic grinding and frictional grinding using a super fiber;

(6) forming of a cell by a powerful laser such as YANG laser, a fiber laser, a femtosecond laser, UV laser with superior absorption rate or the like; and (7) forming of a hard film having an anti-printing force such as a chromium plating or titanium carbide film or DLC film or organic hard film and the like.

[Laser Photo-Sensing, Development and Etching Printed Plate Against a Ballade Plating Type Roll]

The roll for using again by peeling a used ballade plating is processed by a series of processing steps as follows;

(1) degreasing (=for example, a roll is chucked at its both ends, rotated at a desired speed, alkaline liquid is applied to the roll, cleaned with water, acid liquid is applied to neutralize residual alkaline liquid and these processes are repeated twice and finally washed with water)

(2) coating used waste liquid of photograph (a peeling-based surface treatment);

(3) ballade copper sulfate plating using non-soluble anode (for example, 80 μm to 100 μm)

(4) a middle finish grinding having an electrolytic grinding particle grinding and a grinding particle grinding performed together under application of liquid immersion grinding particle fixed flexible member;

(5) mirror surface finish grinding performed under a co-existence of electrolytic grinding and frictional grinding using a super fiber having no grinding particles fixed;

(6) coating and forming of photo-sensitive film;

(7) image printing by a laser exposure device;

(8) development with alkaline liquid;

(9) cell formation with etching operation;

(10) resist peeling; and

(11) forming of a hard film having an anti-printing force such as a chromium plating, or titanium carbide film or DLC film, organic hard film or the like.

[Laser Ablation and Etching Printed Plate Making Against a Ballade Plating Type Roll]

The roll for using again by peeling a used ballade plating is processed by a series of processing steps as follows;

(1) degreasing;

(2) coating used waste liquid of photograph;

(3) ballade copper sulfate plating using non-soluble anode;

(4) a middle finish grinding having an electrolytic grinding particle grinding and a grinding particle grinding performed together under application of liquid immersion grinding particle fixed flexible member;

(5) mirror surface finish grinding performed under a co-existence of electrolytic grinding and frictional grinding using a super fiber having no grinding particles fixed;

(6) coating and forming of black film for laser ablation;

(7) laser ablation performed by a laser ablation device;

(8) forming of a cell with etching;

(9) removal of the black film image;

(10) forming of a hard film having an anti-printing force such as a chromium plating, or titanium carbide film or DLC film, organic hard film or the like.

[Electronic Curving Printed Plate Against the Ballade Plating Type Roll]

The roll for using again by peeling a used ballade plating is processed by a series of processing steps as follows;

(1) degreasing;

(2) coating used waste liquid of photograph;

(3) ballade copper sulfate plating using non-soluble anode;

(4) a middle finish grinding having an electrolytic grinding particle grinding and a grinding particle grinding performed together under application of liquid immersion grinding particle fixed flexible member;

(5) mirror surface finish grinding performed under a co-existence of electrolytic grinding and frictional grinding using a super fiber having no grinding particles fixed;

(6) forming of a cell by an electronic curving device such as a HelioKlischograph or the like for driving a diamond curving needle to curve a cell;

(7) forming of a hard film having an anti-printing force such as a chromium plating, or titanium carbide film or DLC film, organic hard film or the like.

[Laser Curving Printed Plate Against the Ballade Plating Type Roll]

The roll for using it again by peeling the used ballade plating is processed by a series of processing as follows.

(1) degreasing;

(2) coating used waste liquid of photograph;

(3) ballade copper sulfate plating using non-soluble anode;

(4) a middle finish grinding having an electrolytic grinding particle grinding and a grinding particle grinding performed together under application of liquid immersion grinding particle fixed flexible member;

(5) mirror surface finish grinding performed under a co-existence of electrolytic grinding and frictional grinding using a super fiber having no grinding particles fixed;

(6) forming of a cell by a powerful laser such as YANG laser, a fiber laser, a femtosecond laser, UV laser with superior absorption rate or the like; and (7) forming of a hard film having an anti-printing force such as a chromium plating or titanium carbide film or DLC film or organic hard film and the like.

When the hard film having an anti-printing force is a chromium plated one in all the printed plate making methods described in the aforesaid paragraphs. The plating burrs formed at the edge of the cell are removed by a middle finish grinding under a co-existence of the electrolytic grinding particle grinding and the grinding particle grinding by using a liquid immersion grinding particle fixed flexible member having grinding particles fixed at a non-woven fabric with a high frictional strength such as SCOTCH-BRITE™ (a registered trademark) or the like.

Preferred Embodiment 1

FIG. 1 shows a top plan view for showing a printed plate manufacturing factory which can be commonly applied to all the printed plate manufacturing methods described in the aforesaid paragraphs.

A facility configuration shown in FIG. 1 indicates a preferable line facility which can adapt for all the orders through one set of line for a printed plate manufacturing company requiring various kinds of processing steps in response to various orders from a client.

In particular, in the case of the facility configuration shown in FIG. 1, a chromium plating device is not installed and in place of it, this line facility can perform a nickel alloy plating—quenching—thermal radiation cooling.

This printed plate manufacturing factory comprises a robot room A and a plating room B.

The robot room A is provided with an industrial robot 1 having a robot hand 1*a* that can be reciprocated and turned near the plating room B in which a roll R can be chucked at its both ends and handled, and an industrial robot 2 having a robot hand 2*a* that can be reciprocated and turned at a side spaced apart from the plating room B in the robot room A in which a roll R can be chucked at its both ends and handled.

When either the positive or negative type photo—sensitive film is coated within the handling area of the industrial robot 1, a photosensitive film coating device 3*b* placed on the photosensitive film drying and promoting device 3*a* and a laser exposure device 4 are installed, a photosensitive film is coated on the mirror surface ground roll, it is sufficiently dried to enable the development to be performed in a superior manner, a high frequency sintering device 5 and a cooling device 6 are installed, a high frequency sintering is carried out for the nickel alloy plating in place of the chromium plating and then it can be cooled (radiation cooled) and taken out.

The two turn—table type roll stock devices 7A, 7B are stocked in two stages in a circumferential arrangement with the rolls being inclined and their index positions are determined and they are positioned in both handling areas of the industrial robots 1, 2.

The plating room B has, below the running line of a stacker crane 8 installed at its ceiling, a relay table device 9; a middle finish grinding device 10; a mirror surface finish grinding device 11; a photograph waste liquid coating device 12; a cassette stock table 13 for storing a cassette type roll chuck rotary transferring unit U; a degreasing device 14; a developer device 15; a corrosion device 16; a resist peeling—off device 17; a under nickel plating device 18; two copper sulfate plating devices 19, 19; two nickel alloy plating devices 20, 20 in place of chromium plating; a cassette assembling table device 21; and a cassette stock table 22.

As an outline, there are provided an NC lathe 23 capable of performing a precision cylindrical machining for a cell—image cutting; a roll measuring device 24; and a proof printing machine 25.

The middle finish grinding device 10 performs a middle finish grinding by a grinding operation under a co-existence of electrolytic grinding particle grinding and a grinding particle grinding using the liquid immersion grinding particle fixed flexible member.

The mirror surface finish grinding device 11 performs a mirror surface finish grinding under a co-existence of the electrolytic grinding and a frictional grinding using the super fiber having no grinding particles fixed.

The industrial robot 2, quenching device 5 and cooling device 6 may be installed as the outline facility. In addition, the NC lathe 23 and the roll measuring device 24 may be installed as the in-line facility. Although the sand paper grinding device can be installed at the line, the middle finish grinding device 10 can also act as one for removing the plating burrs.

The transferring means for the roll R in the plating room is operated under a cooperative action between the stacker crane 4 and the cassette type roll chuck rotary transferring unit U provided with a pair of opposing chuck means.

As disclosed in the gazettes of Japanese Patent Laid-Open No. Sho 55-164095 and Japanese Patent Publication No. Sho 57-36995, for example, the cassette type roll chuck rotary transferring unit U is constituted such that the roll R is chucked at its both ends by a pair of opposing chuck means, the outside part of the chuck cone can be sealingly closed, and further it can be rotated when it is mounted at each of the devices, a plating current can be flowed through the chuck cone as desired.

This facility may be constructed such that there is provided a reciprocatable and turnable running type industrial robot having a robot hand capable of chucking the roll R at its both ends and handling it and further a pair of opposing chuck means capable of chucking the roll at its both ends against each of the devices 10 to 20, rotating it and flowing a plating current through a chuck cone as desired in place of the stacker crane 8 and the cassette type roll chuck rotary transferring unit U.

The facility configuration shown in FIG. 1 enables the printed plate manufacturing methods described in the aforesaid paragraphs. In addition, the processing step of plating process, middle finish grinding and mirror surface finish grinding can be also applied to the printed plate manufacturing methods described in the aforesaid paragraphs. All the printed plate manufacturing methods described above can be performed if a laser ablation device or an electronic curving device or a laser curving device or the like is installed.

Preferred Embodiment 2

This preferred embodiment constitutes a part of the printed plate manufacturing method and referring now to the drawings, the preferred embodiment about the copper sulfate plating using non-soluble anode will be described in detail.

Figure 2:
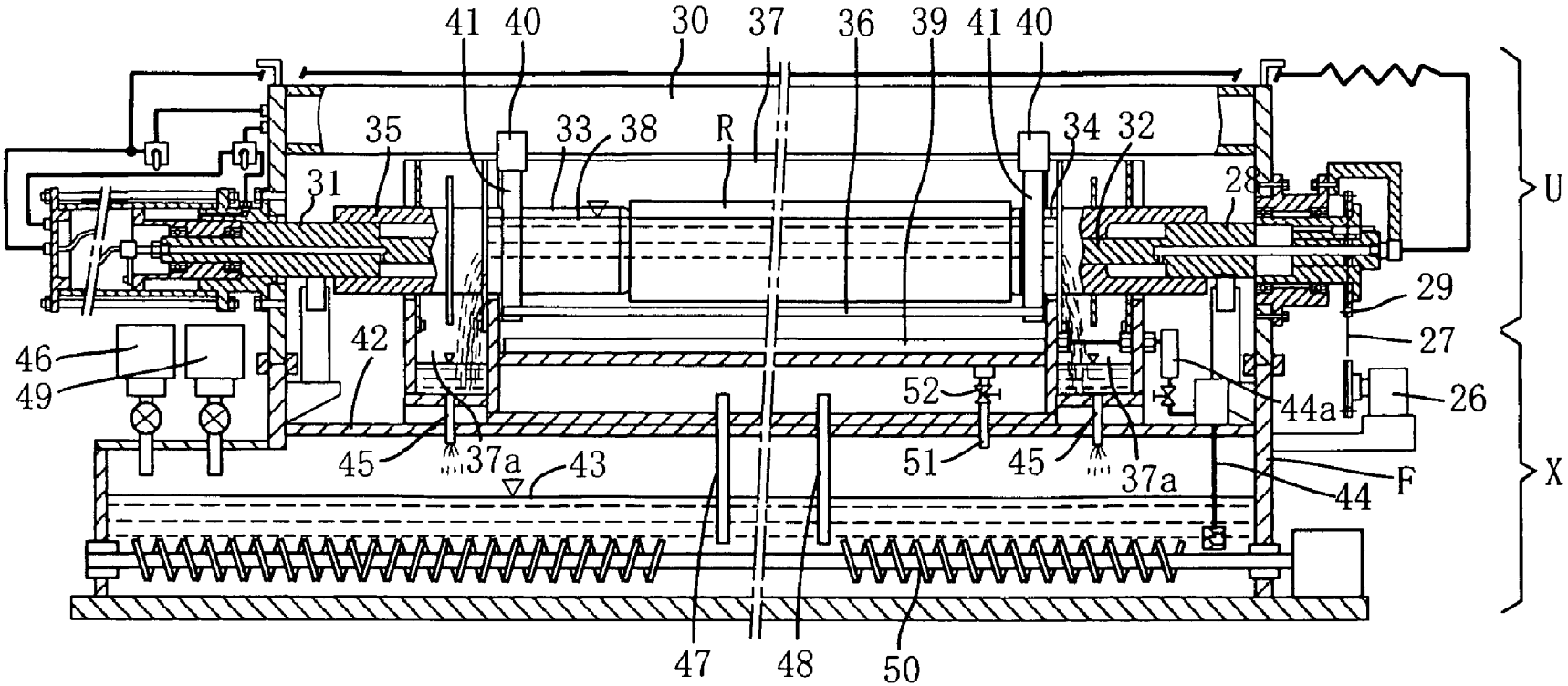
FIG. 2 shows a front elevational view in longitudinal section of a cylindrical grinding device of a preferred embodiment 2 of the present invention.

FIG. 2 shows the copper sulfate plating device using the non-soluble anode applicable to the substantial same the cassette type roll chuck rotary transferring unit as the cassette type roll automatic loading or unloading device disclosed in the gazette of Japanese Patent Publication No. Sho 57-36995, wherein the cassette type roll chuck rotary transferring unit U is mounted on the plating device main body X to perform a copper sulfate plating.

This point will be described in more detail, wherein when the cassette type roll chuck rotary transferring unit U is mounted on the plating device main body X, a sprocket 29 fitted to and fixed to a spindle 28 at a driving side of the cassette type roll chuck rotary transferring unit U is engaged with a chain 27 of the chain winding device driven by a motor 26 installed at the plating device main body X.

The cassette type roll chuck rotary transferring unit U is constituted such that conical holes at both ends of the roll R are supported by a pair of electrically energizable roll chucks 32, 33 arranged at the extremity ends of a pair of spindles 28, 31 arranged at both ends of a hanging frame 30 and opposing to each other, a pair of liquid-proof caps 34, 35 fitted to each of the spindles 28, 31 are moved, abutted against the end surface of the roll R so as to prevent processing liquid from entering into the roll chucks 32, 33 electrically energized.

The spindles 28, 31 of the cassette type roll chuck rotary transferring unit U are contacted with a sliding brush connected to the cathode. Accordingly, the roll R rotated by the motor 26 is connected to the cathode. The process roll R is rotated through driving of the motor 26, a plating current is flowed between the roll R and a non-soluble anode 36 to perform a plating.

This copper sulfate plating device is operated such that the cassette type roll chuck rotary transferring unit U transferred by the stacker crane is mounted on a frame F of the plating device main body X, the roll R for a gravure printing chucked at its both ends by the cassette type roll chuck rotary transferring unit U is immersed in a plating liquid 38 stored in a plating tank 37, the non-soluble anode 36 is lifted up and approached the lower surface of the roll R with a gap against it being 5 mm to 30 mm, a supersonic wave is oscillated from a supersonic wave device 39, a desired higher plating current than a normal plating current is flowed to cause the non-soluble anode 36 to become an anode and the roll R to become a cathode, and thereby a copper sulfate plating is carried out.

The non-soluble anode 36 is supported at locations near longitudinal both ends by brackets 41 connected to a lifter device 40. When the roll R is positioned in the plating tank 37, the lifter device 40 is operated to lift up the non-soluble anode 36, and the roll opposing surfaces of the non-soluble anode 36 approach in parallel with it to attain a gap of about 5 mm to 30 mm against the lower surface of the roll R. The non-soluble anode 36 is assured in its length more than the maximum length of the roll R and its roll opposing surface is kept smooth. An ascending stroke of the non-soluble anode 36 is calculated by inputting diameter data in advance when a respective process roll R is to be processed at the plating line. A diameter of the roll and an immersing depth of the roll in the plating liquid determine a plated area, so that a requisite plating current can be determined in reference to a plating current density to be applied to the roll and a plated area.

This copper sulfate plating device feeds a plating liquid 43 stored in a plating liquid supplementing tank 42 to the plating tank 37 by a plating liquid supplying means 44 comprised of a chuck type liquid lifting port, a liquid lifting pump, pipes, a flow rate adjusting valve and a filter 44*a* or the like so as to supplement copper ion lacked in the plating tank 37. Presence of the filter 44*a* for catching unavoidable impurities enables occurrence of pits or nibs caused by adhesion of the unavoidable impurities during plating operation to be avoided.

This copper sulfate plating device is constituted such that the plating tank 37 is provided with overflow tanks 37*a* at longitudinal both ends, a liquid surface level of the plating liquid in the plating tank 37 is monitored through an overflow system in such a way that the roll R is completely immersed in the plating liquid 38, the overflowing plating liquid is returned back to the plating liquid supplementing tank 42 through a liquid returning means (a pipe passage) 45 under a gravity flowing-down system.

Further, it is applicable that the plating tank 37 is not of a fixed type having the aforesaid configuration, but of a rise and fall type.

This copper sulfate plating device is constructed such that there is provided a current accumulation meter to calculate a plating current every time a plating of one roll R is started and calculate a current at the time of finishing the plating operation; a requisite amount of copper inclusive fine powder such as cupric oxide powder, copper carbonate powder or copper sulfate powder acting as a copper source corresponding to the consumed amount of copper ion at the time of finishing the plating of one roll R is measured by an automatic powder measuring and feeding device 46 and fed into the plating liquid supplementing tank 42; when such a feeding is repeated by several times, a copper concentration of the plating liquid 43 is displaced from a monitoring target value, so that the copper concentration of the plating liquid in the plating liquid supplementing tank 42 is always measured by a copper concentration sensor 47; and this device employs a double monitoring system in which when the copper concentration sensor 47 detects a lack of the copper concentration, a requisite amount of the copper inclusive fine powder is rapidly measured by the automatic powder metering and feeding device 46, the powder is fed into the plating liquid supplementing tank 42, and in turn when the copper concentration sensor 47 detects that the copper concentration is not lack at the time of finishing plating of one roll R, no feeding of copper inclusive fine powder from the automatic powder metering and feeding device 46 into the plating liquid supplementing tank 42 is carried out.

In addition, this copper sulfate plating device employs a monitoring system constructed such that a sulfuric acid concentration of the plating liquid in the plating liquid supplementing tank 42 is always measured by a sulfuric acid concentration sensor 48, wherein when the sulfuric acid concentration sensor 48 detects that the sulfuric acid concentration is lack, a requisite amount of sulfuric acid at that time is measured by a automatic sulfuric acid metering and feeding device 49 and supplemented into the plating liquid supplementing tank 42.

The automatic powder metering and feeding device 46 is constructed such that a requisite amount of copper inclusive fine powder such as cupric oxide powder, copper carbonate powder or copper sulfate powder is automatically metered in advance, stored in a chamber having a feeding port at its lower end and having a valve, and when an electrical signal outputted by the copper concentration sensor is inputted, the valve is opened to feed the copper inclusive fine powder in the chamber into the plating liquid supplementing tank.

In addition, the sulfuric acid automatic metering and feeding device 49 is constructed such that a requisite amount of liquid is automatically metered in advance, stored in a feeding tank in advance, and when an electrical signal outputted by the sulfuric acid concentration sensor is inputted, the valve of the feeding tank is opened to feed the requisite amount of sulfuric acid into the plating liquid supplementing tank.

This copper sulfuric acid plating device feeds sulfuric acid and copper inclusive fine powder such as cupric oxide powder, copper carbonate powder or copper sulfuric acid powder from one side of the plating liquid supplementing tank 42 under a requisite rate, they are agitated by an agitator device 50 to generate copper ion (positive ion).

A reaction formula is $CuO+H_2SO_4 \rightarrow CuSO4+H_2O$ . . . when cupric oxide powder, for example, is used.

With the foregoing arrangement, the plating liquid is fed from the plating liquid supplementing tank 42 into the plating tank 37 by the plating liquid supplying means 44 comprised of the chuck valve type liquid lifting port, liquid lifting pump, pipes, flow rate adjustment valve and filter 44*a* for catching unavoidable impurities so as to supplement copper ion lacked in the plating tank 37 and at the same time the plating liquid in the plating tank 37 is monitored in an over-flow system in such a way that the liquid level of the plating liquid is approximately immersed in full, the overflowing plating liquid is returned back to the plating liquid supplementing tank 42 through the liquid returning means (pipe) 45 in a gravity flowing-down system.

Further, when the plating operation is finished, an automatic opening or closing valve 52 arranged in a liquid dropping pipe 51 connecting the plating tank 37 with the plating liquid supplementing tank 42 is opened to enable the plating liquid in the plating tank 37 to be recovered into the plating liquid supplementing tank 42.

With the foregoing arrangement, a superior copper sulfate plating can be continued because the copper ion concentration in the plating liquid can be always monitored to the appropriate state. Then, nibs or pits are not formed at the surface of the copper sulfate plating adhered to the roll because anode sludge is not generated at the plating tank, the copper sulfate plating of neat surface can be formed within a short period of time, it is possible to reduce a thickness of the plating, reduce a plating time and reduce a failure of the printed plate manufacturing because applying of an electrolytic grinding particle grinding during the printed plate forming operation enables a quite superior mirror surface grinding having no nibs or pits even if the grinding margin is low.

Preferred Embodiment 3

This preferred embodiment constitutes a part of the printed plate manufacturing method, wherein referring now to the drawings, the preferred embodiment relating to the middle finish grinding using the liquid immersion grinding particle fixed flexible member and the mirror surface finish grinding with the super fiber having no grinding particles fixed there will be described in detail.

Figure 3:
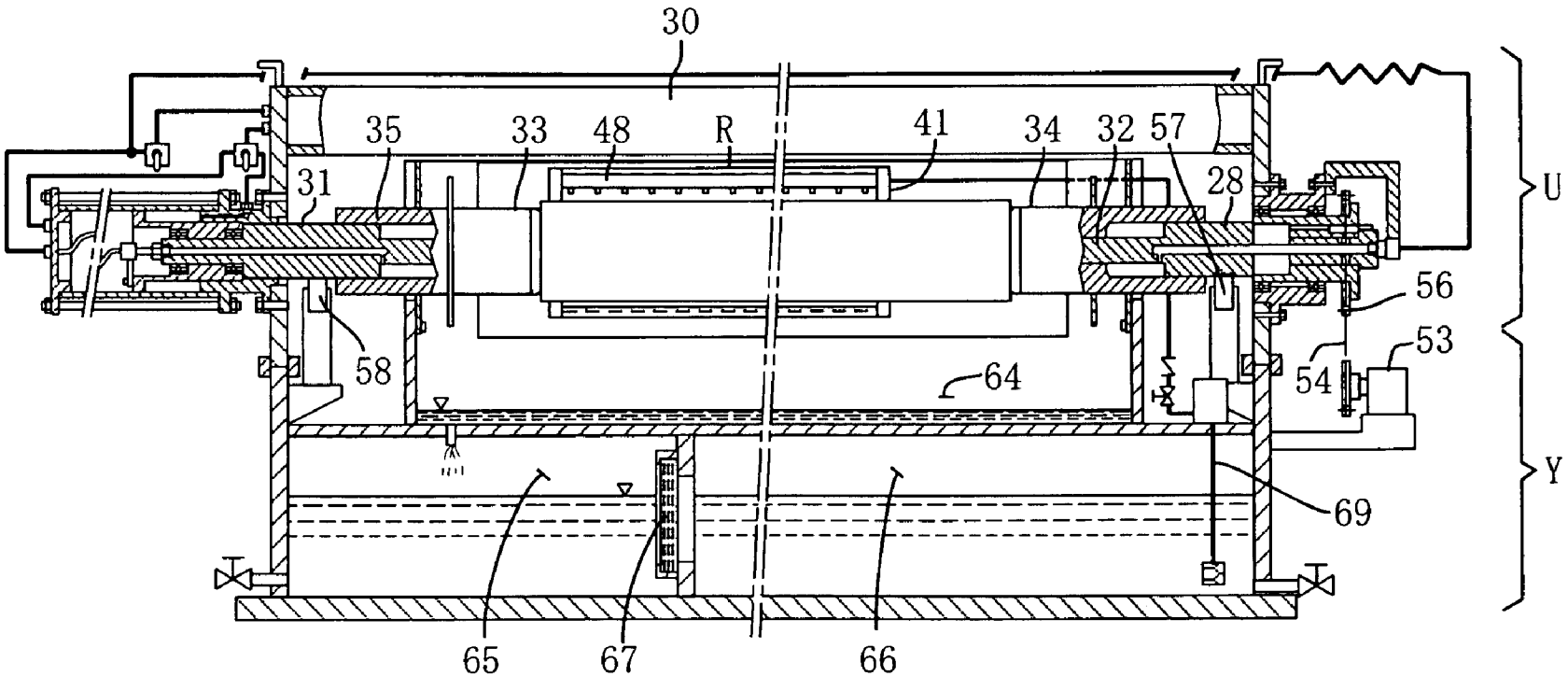
FIG. 3 shows a front elevational view in longitudinal section of a cylindrical grinding device of a preferred embodiment 3 of the present invention.
Figure 4:
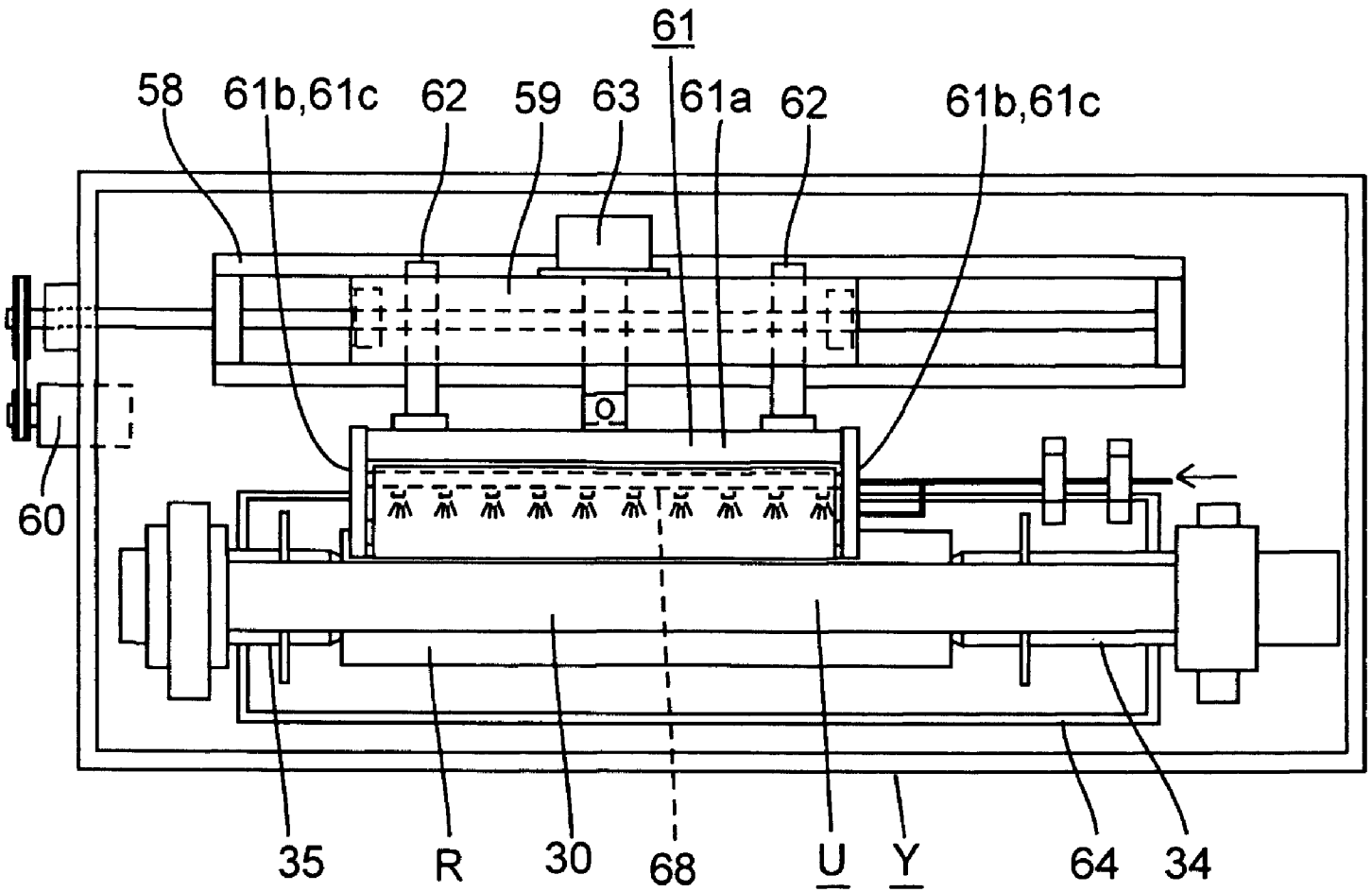
FIG. 4 shows a top plan view of a cylindrical grinding device of a preferred embodiment 3 of the present invention.
Figure 5A:
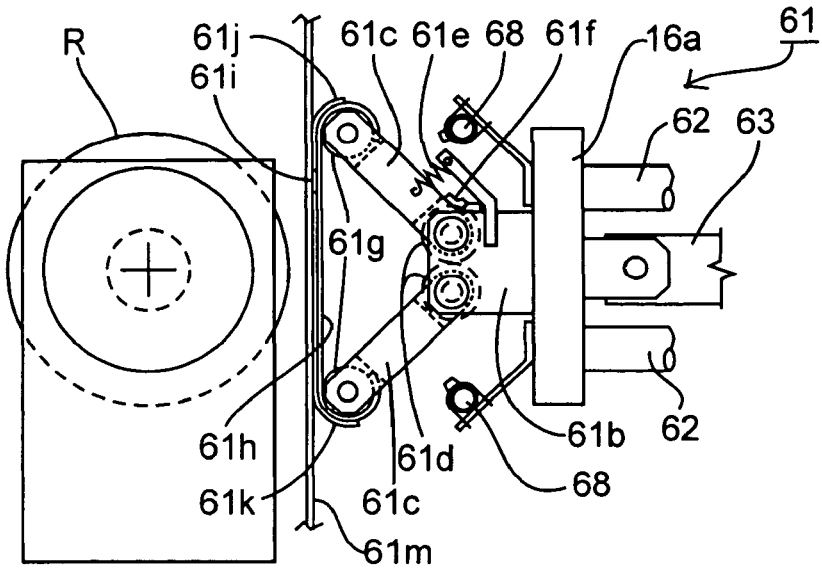
FIG. 5*a* shows a state before grinding operation of a roll having a maximum diameter.
Figure 5B:
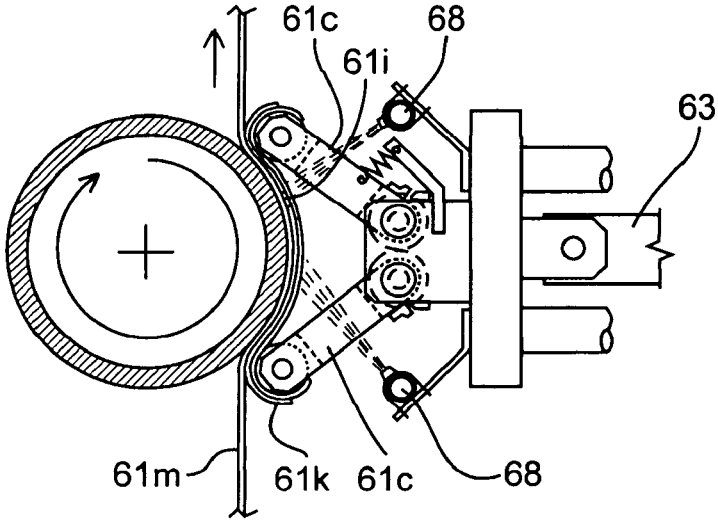
FIG. 5*b* shows a state during grinding operation of a roll having a maximum diameter.
Figure 5C:
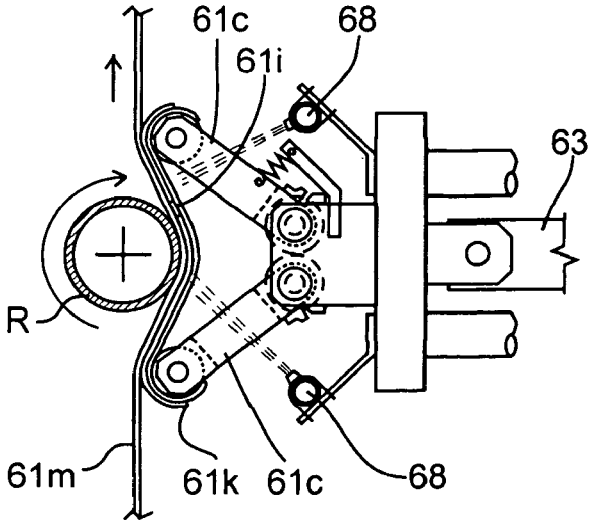
FIG. 5*c* shows a state before grinding operation of a roll having a minimum diameter.

FIG. 3 shows a top plan view of the cylindrical grinding device for performing an electrolytic grinding type cylindrical grinding method against the roll for a gravure printing of the present invention, wherein FIG. 4 shows its top plan view and FIGS. 5*a*, 5*b* and 5*c* show a substantial side elevational view in longitudinal section.

The cassette type roll chuck rotary transferring unit U is mounted on the device main body Y to perform a cylindrical grinding. The cassette type roll chuck rotary transferring unit U has a substantial same configuration as that of the cassette type roll automatic loading or unloading device shown in the gazette of Japanese Patent Publication No. Sho 57-36995. Accordingly, the cassette type roll chuck rotary transferring unit U is denoted by the same reference numerals as those shown in FIG. 2 and its description will be eliminated.

When the cassette type roll chuck rotary transferring unit U is mounted on the frame of the device main body Y, a sprocket 56 fitted to and fixed to a driving side spindle 28 of the cassette type roll chuck rotary transferring unit U is engaged with a chain 54 of the chain winding device driven by a motor 53 installed at the device main body X.

Differing from the case of plating operation, the spindles 28, 31 of the cassette type roll chuck rotary transferring unit U are contacted with electrical sliding brushes 57, 58 connected to the anode. Accordingly, the roll R rotated by the motor 53 is connected to the anode.

As shown in FIG. 4, the device main body Y is constructed such that a slide block 59 guided by a linear moving guide 58 is moved by a servo motor 60.

A grinding head 61 is operated such that the two horizontal guides 62, 62 fixed at both ends of the rear surface of a grinding head main body 61*a*, for example, are fitted to and guided by a guide hole in the slide block 59, the extremity of a piston rod of an air cylinder 63 having its cylinder main body fixed to the slide block 59 is pivotally attached to the rear surface of the grinding head main body 61*a*, thereby the grinding head 61 is contacted to or moved away from the roll R through an extending or retracting operation of the air cylinder 63.

Returning again to FIG. 3, the device main body Y will be described as follows.

The device main body Y comprises a grinding tank 64; an electrolytic liquid returning tank 65; an electrolytic liquid storing tank 66; a metallic powder catching filter 67; a shower pipe 68 for applying shower toward a grinding location of the grinding head 61; and a liquid supplying means 69 comprised of a check valve type liquid lifting port, a liquid lifting pump, pipes, flow rate adjusting valve and filter or the like and for supplying the electrolytic liquid stored in the electrolytic liquid storing tank 66 to the shower pipe 68.

Electrolysis plating liquid composed of pure water including sodium nitride of 1 wt % is stored in the electrolytic liquid storing tank 66. Then, a requisite amount of acid is put into the electrolytic liquid to keep the electrolytic liquid in acid state. Preferably, its pH is about 3.0.

The shower pipe 68 is supported by the grinding head main body 61*a* and integrally reciprocated.

The grinding tank 64 is an open tank, receives the showered electrolytic liquid, and returns it to the electrolytic liquid returning tank 65 through a drain pipe.

The electrolytic liquid returned back to the electrolytic liquid returning tank 65 passes through the metallic powder catching filter 67, the metallic powder is removed and then the electrolytic liquid is returned back to the electrolytic liquid storing tank 66.

Although the grinding tank 64 is an open tank, it is assumed that the drain pan can be opened or closed in such a way that alkaline liquid shower for neutralizing the roll surface after grinding and its subsequent shower such as tap water may not be dropped into the grinding tank 64.

The metallic powder returned back to the electrolytic liquid returning tank 65 is substantially dissolved with acid, so that it may also be applicable that an ion exchanger tower for catching metallic ion is installed at the electrolytic liquid returning tank 65.

Its operation will be described s follows.

The motor 53 installed at the device main body Y is driven to cause the roll R to be rotated in a predetermined number of rotation. Then, the air cylinder 63 extends or retracts to cause the grinding head 61 to be slidingly contacted with the rotating roll R and a cylindrical grinding is started and at the same time the pump of the liquid supplying means 69 is operated, the shower pipe 68 injects a shower of the electrolytic liquid toward the rear surface of the grinding location of the grinding head 61. Then, the servo-motor 60 is driven and the slide block 59 starts to reciprocate from its waiting position in a longitudinal direction of the process roll R. The slide block 59 reciprocates in such a way that both ends of the grinding head 61 extend in an outward direction of the end edge of the roll R by about 50 mm, for example.

Although not shown, there is provided a shower means for neutralizing and water washing after completion of the grinding. This shower means initially provides a shower of alkaline liquid to neutralize the acid electrolytic liquid, then provides a shower of neutralizing water such as tap water. During this shower providing operation, it is constructed such that the receiving pan comes below the roll to avoid its mixing with electrolytic water showered at the time of grinding operation.

The grinding head 61 will be described in detail as follows.

As shown in FIG. 5*a*, the grinding head 61 is constructed such that a pair of brackets 61*b* are installed at both front sides of the grinding head main body 61*a*; upper and lower leg opening links 61*c*, 61*c* are pivotally arranged at each of the brackets 61*b*; gears 61*d*, 61*d* fixed to both base portions of the leg opening links 61*c*, 61*c* at each of the sides are outwardly contacted and engaged to each other; the upper and lower leg opening links 61*c*, 61*c* are oscillated to their maximum opened state by a spring 61*e* and a stopper 61*f*; a horizontal bar 61*g* is supported at its both ends between the extremity ends of the upper side opening leg links 61*c* and between the extremity ends of the lower side opening leg links 61*c*; a grinding band pressing web 61*h* made of mesh-like material is fixed at its both ends to the aforesaid two horizontal bars 61*g*, 61*g* and tensioned in a flat plane form; a band-like electrode 61*i* is arranged at the midway part of the grinding band pressing web 61*h*; and rubber plates 61*j*, 61*k* are adhered to the upstream side and the downstream side of the electrode 61*i*, respectively. The grinding head 61 has the electrode 61*i*, and a grinding band 61*m* closely contacted with and tensioned to the rubber plates 61*j*, 61*k*.

The grinding band 61*m* is either liquid immersion grinding particles fixed flexible member having grinding particles fixed there with a high frictional strength such as SCOTCH-BRITE™ or a super fiber having a high frictional strength, high anti-heat strength and high creep strength such as ZYLON™ or the like.

When the grinding band 61*m* is liquid immersion grinding particles fixed flexible member, it is formed into a large ring as viewed in a lateral direction, it is fed to have an opposite rotation against a roll rotation during grinding operation, no grinding is carried out at one location, the lower portion is washed with electrolytic liquid so as to wash away the metallic powder clogged and free grinding particles. Means for running the grinding band 61*m* is not illustrated. A proper feeding means can be employed.

When the grinding band 61*m* is a liquid immersion grinding particles fixed flexible member, it is lifted up from a lower side to an upper side. Although not illustrated in detail, a bobbin is chucked at the lower chuck means, the liquid immersion grinding particles fixed flexible member is wound around the bobbin, and a moment is applied in a rotating direction where the liquid immersion grinding particles fixed flexible member is wound around the bobbin by a torque motor connected to the bobbin, then the liquid immersion grinding particles fixed flexible member fed out of the bobbin is held between the driving roll and a pinch roll above the upper horizontal bar 61*g*, it is pulled out against a biasing of the torque motor and then the member is wound onto a taking-up bobbin.

A state shown in FIG. 5*a* is a state in which the grinding head 61 is kept at a waiting position, the upper and lower opening leg links 61*c*, 61*c* are opened most, a state shown in FIG. 5*b* is a state in which the air cylinder device 63 extends to cause the grinding band 61*m* of the grinding head 61 to be closely contacted with the roll R, the upper and lower opening leg links 61*c*, 61*c* are closed, approached the roll R, stopped there and the grinding operation is being carried out.

A state shown in FIG. 5*c* is a state in which the grinding band 61*m* is closely contacted with the roll R of small diameter, the upper and lower opening leg links 61*c*, 61*c* are being closed, spaced apart from the roll R, stopped there, and the grinding operation is being carried out.

As shown in FIGS. 5*b* and 5*c*, the shower pipe 68 shown in FIGS. 3 and 4 is arranged outside the upper opening leg link 61*c* and the lower opening leg link 61*d*, and the shower liquid is applied to the rear surface of the grinding band pressing web 61*h* toward the electrode 61*i*.

A grinding theory will be described as follows.

Electrolytic liquid is supplied to a close contact surface between the roll R and the grinding band 61*m*, the grinding head 61 is reciprocated in a longitudinal direction of the roll to cause the grinding band 61*m* to be reciprocated in a longitudinal direction of the roll, an electrolytic grinding is carried out at the portion of the roll R corresponding to the electrode 61*i* and a frictional grinding is carried out at the other portion where no electrolytic current flows. The grinding band 61*m* is moved at a slow speed in a longitudinal direction of its own, a grinding position of the grinding band 61*m* against the roll R is revised, thereby a superior grinding condition is maintained.

When the grinding band 61*m* is a liquid immersion grinding particle fixed flexible member having grinding particles fixed at a non-woven fabric having a high frictional strength such as SCOTCH-BRIGHT, it is constituted such that an electrolytic grinding particle grinding is carried out at one portion of the roll R corresponding to the electrode 61*i* and a friction grinding particle grinding is carried out at the other portions (rubber covering portions) 61*j*, 61*k* where no electrolytic current flows. Thus, it is constructed so as to perform to grind a rough finish grinding or to remove the chromium plating burrs.

When the grinding band 61*m* is a super fiber such as ZYLON™ (a registered trademark) or the like having a high frictional strength, anti-heat strength and creep strength, it is constituted such that an electrolytic frictional grinding is carried out at one portion of the roll R corresponding to the electrode 61*i* and a friction grinding is carried out at the other portions (rubber covering portions) 61*j*, 61*k* where no electrolytic current flows, thereby a mirror surface finish grinding is carried out.

The grinding band pressing web 61*h* performs an action for winding the grinding band 61*m* around the roll R and pressing it against the roll.

In the case of performing a grinding operation with SCOTCH-BRITE™, a superior middle finish grinding could be attained under a condition of a circumferential speed of the roll of 200 r.p.m., a speed of the electrode in a longitudinal-direction of the roll of 300 to 400 mm/sec, a current density of 0.025 A/cm$^2$ and a pressure of 150 g/cm$^2$ After grinding with SCOTCH-BRITE™, a grinding with ZYLON™ was carried out. In the case of grinding with ZYLON™, a superior mirror surface finish grinding could be attained under a condition of a circumferential speed of the roll of 200 r.p.m., a speed of the electrode in a longitudinal direction of the roll of 300 to 400 mm/sec, a current density of 0.025 A/cm$^2$ and a pressure of 200 g/cm$^2$.

In the case of installing a line, it is preferable to make a facility in which there are provided separately a cylindrical grinding device capable of performing a rough finish cylindrical grinding by a friction applying with a liquid immersion grinding particle fixed flexible member having the grinding particles fixed to a non-woven fabric of high frictional strength such as SCOTCH-BRITE™ or the like, and a cylindrical grinding device capable of performing a mirror surface finish grinding by a friction applying with a grinding web of a super fiber having no grinding particles fixed.

The cylindrical grinding device capable of performing a rough finish cylindrical grinding with the liquid immersion grinding particle fixed flexible member can remove chromium plating burrs and grind. Although it is possible to make a double-head type two-stage grinding type cylindrical grinding device having one grinding head performing a rough finish cylindrical grinding and the other grinding head performing a mirror surface finish grinding, their separate arrangement is preferable due to producing a high processing capability.

It is preferable that there is provided a grinding head longer than the roll of a maximum length (about 1300 mm) by about 100 mm, a reciprocating stroke for use in grinding at the grinding head is about 100 mm and its full length concurrently abuts against the grinding head, or it is preferable that there is provided a grinding head having a substantial same length as that of the roll having a minimum length (about 500 mm), a reciprocating stroke for use in grinding at the grinding head is about 100 mm against the roll with a minimum length (about 500 mm), or a reciprocating stroke of the grinding head during the grinding operation is about 900 mm against the roll of a maximum length (about 1300 mm).

The roll is constituted such that it is chucked at its both ends, connected to an anode and rotated. It is preferable that both one grinding head performing a rough finish cylindrical grinding and the other grinding head performing a mirror surface finish grinding are a variable grinding head having a back-up function capable of attaining a large contact angle between SCOTCH-BRITE™ or ZYLON™ and the roll for any of the various sized roll for a gravure printing with a diameter range of about 80 mm to 300 mm, for example.

In the case of a variable grinding head, SCOTCH-BRITE™ or ZYLON™ can attain a uniform sliding contact over a full contact length in a circumferential direction of the roll against the roll.

When the liquid immersion grinding particle fixed flexible member such as SCOTCH-BRITE™ having grinding particles fixed on a non-woven fabric is used, an electrolytic grinding particle grinding is carried out at one portion of the roll corresponding to the electrode and a frictional grinding is carried out concurrently at the other portion where no electrolytic current flows, thereby a rough finish grinding is carried out. This operation can be applied to a grinding before copper sulfate plating, a grinding after copper sulfate plating and a grinding for removing chromium plating burrs.

In addition, when the grinding web of a super fiber such as ZYLON™ or the like having grinding particles not fixed is used, an electrolytic frictional grinding is carried out at one portion of the roll corresponding to the electrode and a frictional grinding is carried out at the other portion where no electrolytic current flows, thereby a mirror surface finish grinding is carried out. This operation can be applied to a rough finish after copper sulfate plating and a grinding after middle finish grinding.

Although the grinding band is closely contacted with the roll and pressed against the roll by the grinding head, it includes both one configuration in which the grinding band and the grinding head are separate from each other and the other configuration in which the grinding band and the grinding head are integrally assembled to each other. More preferably, the grinding band is moved at a slow speed during a grinding operation in its own longitudinal direction and the grinding position of the grinding band against the roll is revised.

When the electrolytic liquid is alkaline, non-active film is accumulated during the electrolytic grinding particle grinding of the copper sulfate plating and in order to perform a superior cylindrical full surface grinding, the electrolytic liquid is acid. Then, it is preferable that the electrolytic liquid is supplied to the close contact surface between the roll and the grinding band during the grinding operation, and after the grinding band is moved away from the roll, the alkaline liquid is rapidly showered against the roll and further neutral water is showered, the alkaline shower water and the neutral shower water are not mixed with the acid electrolytic liquid through opening or closing of the receiving pan.

The grinding head main body is not limited to the configuration shown in the aforesaid preferred embodiment 3.

It may also be applicable that the cylindrical grinding is carried out for a roll for a gravure printing by the two-head type device comprised of the first grinding head for a rough finish grinding with SCOTCH-BRITE™ being overlapped and the second grinding head for a mirror surface finish with ZYLON™ being overlapped while they are oppositely arranged. In addition, the grinding operation is carried out by one-head type device under a state in which SCOTCH-BRITE™ and ZYLON™ are replaced.

The present invention may not use the cassette type roll chuck rotary transferring unit, but may be comprised of means capable of chucking the roll at its both ends to the grinding device main body, rotating it at a predetermined number of rotation and connecting the roll to an anode.

The present invention is not limited to a configuration in which a cylindrical grinding is carried out while mounting the cassette type roll chuck rotary transferring unit on the device main body Y. This invention may be constituted such that the device main body Y is provided with a pair of chuck rotating means for chucking the process roll and connecting to the anode and rotating it, and the roll may be given to or received from an industrial robot.

The present invention can perform a mirror surface finish grinding before forming a cell after applying the copper sulfate plating in a shorter time than the grinding time by the grinding stone grinder device, and the present invention can be applied for removing chromium plating burrs generated when the cell is formed and the hard plating is applied to it.

The present invention is not limited to a rough finish grinding and a mirror surface finish grinding for the roll having a copper plating, and a grinding for removing the roll chromium plating burrs generated when the cell is formed and the hard plating is applied to it. The method of the present invention can be applied to all the cylindrical grindings for the roll because the printed plate is formed by applying galvanization to the roll, performing a cylindrical grinding, and curving it with laser to perform a chromium plating, or applying nickel plating to the roll, performing a cylindrical grinding and the cell is formed by various kinds of method.

The invention claimed is:

1. A method for plating and grinding a roll extending along a longitudinal axis and having a cylindrical surface centrally surrounding the longitudinal axis, the method comprising the steps of:

supporting the roll at opposing ends of the roll;

positioning the roll in a plating tank containing a plating liquid with a longitudinally-extending non-soluble anode immersed therein, the plating liquid including copper sulfate and being in liquid contact with the roll;

moving the anode to a juxaposed position adjacent the roll with the roll and the anode extending parallel to one another;

rotating the roll while the roll is in liquid contact with the plating liquid;

electrically energizing the roll as a cathode while being electrically connected to the anode and rotating the roll in the juxtaposes position with the anode so that the cylindrical surface is plated with copper sulfate;

providing a grinding head and a grinding band, the grinding head disposed adjacent the roll and operative to move to and between a roll-engaged position and a roll-disengaged position, the grinding band fabricated from a flexible fabric member and disposed between the roll and the grinding head and operative to move relative to the grinding head and the roll, the grinding head having a flexible web structure supporting a longitudinally-extending electrode band;

moving the grinding head from the roll-disengaged position to the roll-engaged position such the the grinding band is in pressing contact with the rotating roll in a manner that a portion of the grinding band in facial contact with the web structure and at least a portion of the web structure flex to conform to an arcuate portion of the roll with the portion of the grinding band in facial contact with the web structure contacting the arcuate portion of the roll to cause frictional grinding of the arcuate portion of the rotating roll; and electrically energizing the electrode band disposed adjacent the arcuate portion of the roll to cause electrolytic grinding of the rotating roll at a location near the energized electrode band.

2. A method for plating and grinding a roll according to claim 1, further comprising the step of filtering the plating liquid to remove non-soluble impurities contained therein.

3. A method for plating and grinding a roll according to claim 1, wherein the flexible fabric member is either a non-woven fabric of high frictional strength or a super fiber fabric.

4. A method for plating and grinding a roll according to claim 1, further comprising the step of reciprocating the grinding heaf along the longitudinal axis during the electrolytically and frictionally grinding steps.

5. A method for plating and grinding a roll according to claim 1, wherein the anode has a anode length, the roll has a roll length and the anode length is greater than the roll length.

6. A method for plating and grinding a roll according to claim 1, wherein the copper sulfate liquiud includes sulfuric acid mixed with a copper inclusion fine powder consisting of at least one of cupric oxide powder, copper carbonate powder and copper sulfate powder.

7. A method for plating and grinding a roll according to claim 1, wherein at least one of the electrolytically grinding step and the frictionally grinding step is one of a middle finish grinding step and a mirror surface finish grinding step.

8. A method for plating and grinding a roll according to claim 1, wherein the flexible fabric member includes grinding particles fixed thereto.

* * * * *